US012606968B2

(12) United States Patent
Duchscherer et al.

(10) Patent No.: US 12,606,968 B2
(45) Date of Patent: Apr. 21, 2026

(54) SNOWTHROWER HOUSING INCORPORATING BYPASS AND AUGER FOR USE WITH SAME

(71) Applicant: THE TORO COMPANY, Bloomington, MN (US)

(72) Inventors: Derek S. Duchscherer, Eden Prairie, MN (US); Nathan J. Friberg, Bloomington, MN (US)

(73) Assignee: THE TORO COMPANY, Bloomington, MN (US)

( * ) Notice: Subject to any disclaimer, the term of this patent is extended or adjusted under 35 U.S.C. 154(b) by 1287 days.

(21) Appl. No.: 16/287,622

(22) Filed: Feb. 27, 2019

(65) Prior Publication Data

US 2019/0264405 A1 Aug. 29, 2019

Related U.S. Application Data

(60) Provisional application No. 62/636,426, filed on Feb. 28, 2018.

(51) Int. Cl.
*E01H 5/09* (2006.01)

(52) U.S. Cl.
CPC ..... *E01H 5/098* (2013.01)

(58) Field of Classification Search
CPC .. E01H 5/098; E01H 5/09; E01H 5/04; E01H 5/045
See application file for complete search history.

(56) References Cited

U.S. PATENT DOCUMENTS

| | | | | |
|---|---|---|---|---|
| 5,127,174 | A * | 7/1992 | Takeshita | E01H 5/04 37/250 |
| 5,209,003 | A * | 5/1993 | Maxfield | E01H 5/098 37/252 |
| 5,438,770 | A * | 8/1995 | Miller | E01H 5/04 37/227 |
| 6,453,583 | B1 | 9/2002 | Hanafusa et al. | |
| 6,539,649 | B2 | 4/2003 | Sueshige et al. | |
| 6,938,364 | B2 | 9/2005 | White, III et al. | |
| 8,844,172 | B2 * | 9/2014 | Cmich | E01H 5/096 37/248 |
| 9,359,734 | B2 * | 6/2016 | Favorito | E01H 5/09 |

(Continued)

OTHER PUBLICATIONS

Ariens Sno-Thro, Deluxe Series, Models 921045—Deluxe 24; 921046—Deluxe 28; 921047—Deluxe 30; and 921048—Deluxe 28 SHO, Operator's Manual. Form No. 05001300B; Ariens, Brillion WI, Copyright Jun. 2016; 30 pages.

*Primary Examiner* — Christopher J Sebesta
(74) *Attorney, Agent, or Firm* — Mueting Raasch Group

(57) ABSTRACT

A housing for a snowthrower including an auger housing and an impeller housing. The auger housing may include a front portion and a rear portion protruding from a rear wall of the front portion. The impeller housing may be coupled to the auger housing at a rear-facing opening of the rear portion. At least a portion of the rear portion and the impeller housing form a bypass passage adapted to return snow that bypasses a discharge outlet. The snowthrower may also include an auger that includes a helical flyte adapted to collect snow. The helical flyte may include a first helical portion and a second helical portion, wherein the first helical portion is overlapping and coupled to the second helical portion.

8 Claims, 13 Drawing Sheets

(56) References Cited

U.S. PATENT DOCUMENTS

| | | | | |
|---|---|---|---|---|
| 2004/0255492 | A1* | 12/2004 | White, III | E01H 5/04 37/244 |
| 2012/0279093 | A1* | 11/2012 | Niemela | E01H 5/098 37/242 |
| 2021/0262183 | A1* | 8/2021 | Favorito | E01H 5/065 |

* cited by examiner

SNOWTHROWER HOUSING INCORPORATING BYPASS AND AUGER FOR USE WITH SAME

This application claims the benefit of U.S. Provisional Application No. 62/636,426, filed Feb. 28, 2018, which is incorporated herein by reference in its entirety.

Embodiments described herein are directed generally to snowthrowers, and more specifically, to housings and augers for use with snowthrowers.

BACKGROUND

Walk-behind snowthrowers typically fall into one of two categories. Two-stage snowthrowers include a horizontally-mounted, rigid helical auger that cuts snow and moves it at a low speed transversely toward a discharge area. Once the snow reaches the discharge area, a higher speed impeller collects and ejects the snow outwardly away from the snowthrower through a discharge chute. Wheels supporting two-stage snowthrowers are typically powered to propel the snowthrower over a ground surface during operation.

Conversely, single stage snowthrowers typically achieve both snow collection and ejection using a horizontally mounted, high-speed rotor. The rotor may be shaped to move the snow transversely toward a discharge area. At or near the discharge area, the rotor may include paddles configured to directly eject the snow outwardly through a discharge chute.

Further, snowthrowers may come in a variety of widths. Typically, the auger (or rotor) is manufactured specifically to achieve the particular width of the snowthrower.

Snow that is transported by the impeller of a two-stage snowthrower may sometimes clog or plug the discharge outlet (e.g., when the snow is wet and heavy). Often, an operator must shut off the engine and insert some type of tool into the discharge outlet (e.g., through the discharge chute) to dislodge the clog or plug.

SUMMARY

Embodiments described herein may provide an auger that includes multiple portions that are nested at different overlap distances to alter the overall auger width. For example, in one embodiment, a snowthrower housing may include two spaced-apart sidewalls connected to one another by a rear wall to define a front-facing collection opening. The rear wall or an upper wall of the housing may further define a discharge outlet. The snowthrower housing may also include an auger positioned within the housing between the collection opening and the rear wall. The auger may be adapted to rotate in a first direction, relative to the housing, about an auger axis. The auger may include a helical flyte adapted to collect snow. The helical flyte may include a first helical portion extending between a first end and a second end and a second helical portion extending between a first end and a second end. The first helical portion may be coupled to the second helical portion such that the second end of the first helical portion and the first end of the second helical portion overlap at an overlap section. The first helical portion may be adapted to overlap the second helical portion by either: a first overlap distance such that the helical flyte defines a first width measured along the auger axis, or a second overlap distance such that the helical flyte defines a second width measured along the auger axis different than the first width.

Other embodiments described herein may provide an auger housing and an impeller housing that combine to form a bypass housing adapted to accommodate snow. For example, in one embodiment, a snowthrower housing may include an auger housing, an impeller housing, an auger, and an impeller. The auger housing may include a front portion and a rear portion. The front portion may include two spaced-apart sidewalls connected to one another by a rear wall to define a front-facing collection opening. The rear portion may protrude from the rear wall of the front portion and may define a rear-facing opening. The impeller housing may be coupled to the auger housing at the rear-facing opening of the rear portion. The impeller housing may define a discharge outlet. At least a portion of the rear portion of the auger housing and the impeller housing may form a bypass passage adapted to return snow that bypasses the discharge outlet to the auger housing. The auger may be positioned within the auger housing between the collection opening and the rear wall. The auger may be adapted to rotate in a first direction, relative to the auger housing, about an auger axis. The auger may be adapted to collect snow. The impeller may be positioned within the impeller housing and may be adapted to receive snow transported by the auger and to eject the snow outwardly through the discharge outlet.

The above summary is not intended to describe each embodiment or every implementation. Rather, a more complete understanding of various illustrative embodiments will become apparent and appreciated by reference to the following Detailed Description of Exemplary Embodiments in view of the accompanying figures of the drawing.

BRIEF DESCRIPTION OF THE VIEWS OF THE DRAWING

Exemplary embodiments will be further described with reference to the figures of the drawing, wherein.

Figure 1A:
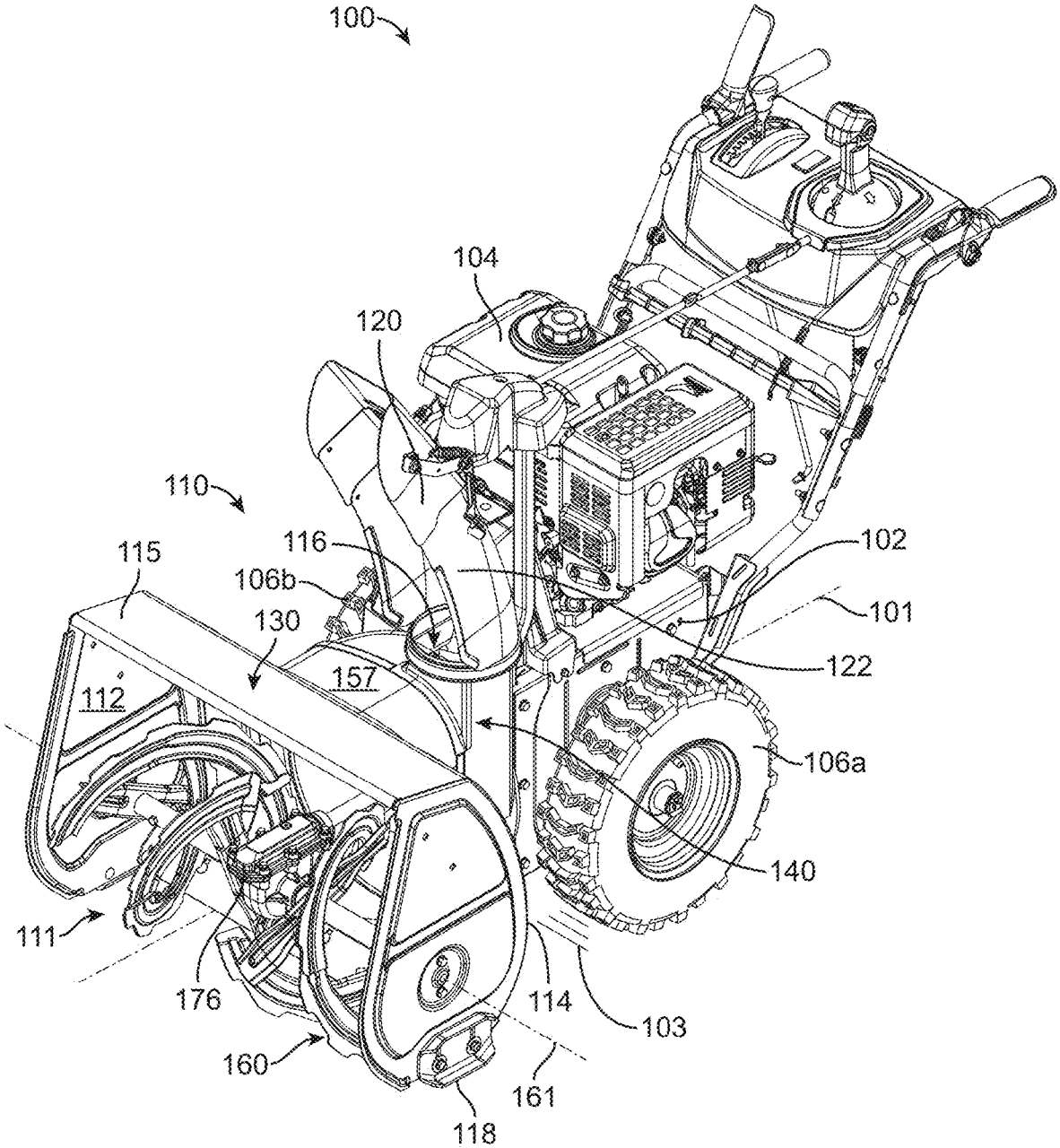
FIG. 1A is a left front perspective view of a snowthrower in accordance with an embodiment of the present disclosure.

The figures are rendered primarily for clarity and, as a result, are not necessarily drawn to scale. Moreover, various structure/components, including but not limited to fasteners, electrical components (wiring, cables, etc.), and the like, may be shown diagrammatically or removed from some or all of the views to better illustrate aspects of the depicted embodiments, or where inclusion of such structure/components is not necessary to an understanding of the various exemplary embodiments described. The lack of illustration/description of such structure/components in a particular figure is, however, not to be interpreted as limiting the various embodiments in any way.

DETAILED DESCRIPTION OF ILLUSTRATIVE EMBODIMENTS

In the following detailed description of illustrative embodiments, reference is made to the accompanying figures of the drawing which form a part hereof. It is to be understood that other embodiments, which may not be described and/or illustrated herein, are certainly contemplated. Unless otherwise indicated, all numbers expressing quantities, and all terms expressing direction/orientation (e.g., vertical, horizontal, parallel, perpendicular, etc.) in the specification and claims are to be understood as being modified in all instances by the term "about." The term "and/or" (if used) means one or all of the listed elements or a combination of any two or more of the listed elements. "I.e." is used as an abbreviation for id est, and means "that is." "E.g.," is used as an abbreviation for exempli gratia, and means "for example."

A two-stage snowthrower is an efficient solution in many snow removal applications. An auger positioned within a portion of a housing (e.g., an auger housing) of the snowthrower rotates (e.g., about a transverse axis) to collect snow and push the snow towards an impeller. The impeller positioned in another portion of the housing (e.g., in an impeller housing) of the snowthrower receives the snow from the auger and rotates (e.g., about a longitudinal axis generally perpendicular to the transverse axis) to eject the snow through a discharge outlet defined by the housing (e.g., the discharge outlet is typically located in a top surface of the impeller housing). The auger housing may, in some snowthrowers, be separate from the impeller housing. For example, due to the differing geometries of each, these portions of the housing may be manufactured separately and coupled together during manufacturing. Stated another way, the auger housing may be wide to define a large opening to collect snow, while the impeller housing may be cylindrical or barrel-shaped to match the profile of a rotating impeller. As such, the impeller housing (e.g., the barrel-shaped portion) may be coupled to the auger housing (e.g., the wider portion) through a circular or corresponding opening at a rear side (e.g., near the center) of the auger housing that is smaller than the entire width thereof.

Further, some two-stage snowthrowers may include a bypass member located proximate the impeller and the discharge outlet to provide a path for snow to bypass the discharge outlet to, e.g., help prevent clogging or plugging the discharge outlet. In other words, the bypass member may provide a bypass chamber to relieve the snow load through the discharge outlet by the impeller. The bypass member may be coupled to one or both of the auger housing and the impeller housing. This may require an additional component (e.g., the bypass member) that must be separately coupled to the housing of the snowthrower. For example, U.S. Pat. No. 6,938,364 to White, III et al. (which is herein incorporated by reference) describes a bypass member that is attached to the top of the auger housing and impeller housing. Additionally, the discharge outlet may be defined in the bypass member and, in some embodiments, the discharge chute extending from the discharge outlet may be formed as a single piece with the bypass member.

However, embodiments of the present disclosure may provide a housing of the snowthrower with the bypass chamber integrated therein, negating the need for a separate bypass member. For example, the bypass chamber may be formed in one or both of at least a portion of the auger housing and at least a portion of the impeller housing. For example, a rear portion of the auger housing and the impeller housing may be shaped to provide a bypass passage to allow snow to travel through when bypassing the discharge outlet. When the auger housing and the impeller housing are coupled together, the bypass passage may be fully formed. Further, by forming the bypass passage in portions of one or both of the auger housing and the impeller housing, the snowthrower may be more efficiently manufactured and assembled than when using a separate bypass member that is attached to the housing.

With reference to the figures of the drawing, wherein like reference numerals designate like parts and assemblies throughout the several views, FIG. 1A illustrates a variable speed, self-propelled, two-stage snowthrower 100. While so described and illustrated, such a construction is not limiting as aspects of the depicted/described embodiments may find application to other types of snowthrowers (e.g., those that attach as implements to general purpose vehicles, single-stage snowthrowers, etc.) as well as to other types of power equipment.

It is noted that the terms "comprises" and variations thereof do not have a limiting meaning where these terms appear in the accompanying description and claims. Further, "a," "an," "the," "at least one," and "one or more" are used interchangeably herein. Moreover, relative terms such as "left," "right," "front," "fore," "forward," "rear," "aft," "rearward," "top," "bottom," "side," "upper," "lower," "above," "below," "horizontal," "vertical," and the like may be used herein and, if so, are from the perspective of one operating the snowthrower 100 while the snowthrower is in an operating configuration, e.g., while the snowthrower 100 is positioned such that wheels 106 and skids 118 rest upon a generally horizontal ground surface 103 as shown in FIG. 1A. These terms are used only to simplify the description, however, and not to limit the interpretation of any described embodiment.

Still further, the suffixes "a" and "b" may be used throughout this description to denote various left- and right-side parts/features, respectively. However, in most pertinent respects, the parts/features denoted with "a" and "b" suffixes are substantially identical to, or mirror images of, one another. It is understood that, unless otherwise noted, the description of an individual part/feature (e.g., part/feature identified with an "a" suffix) also applies to the opposing part/feature (e.g., part/feature identified with a "b" suffix). Similarly, the description of a part/feature identified with no suffix may apply, unless noted otherwise, to both the corresponding left and right part/feature.

As illustrated in FIG. 1A, the snowthrower 100 may include a chassis or frame 102 (having first and second lateral sides and defining a centerline longitudinal axis 101) supporting a power source or prime mover, e.g., internal combustion engine 104. One or more (e.g., a pair of) ground support members, e.g., first and second drive members (e.g., wheels 106), may be coupled, one on or near each of a first (e.g., left) and a second (e.g., right) side of the frame 102 (left drive wheel 106*a* is mostly visible in FIG. 1A, while right drive wheel 106*b* is only partially visible in FIG. 1A). As further described below, the wheels 106 may be selectively powered by the engine 104, in one embodiment, to propel the snowthrower 100 over the ground surface 103 in a direction parallel to the longitudinal axis 101 (when travelling in a straight line). In some embodiments, the snowthrower 100 may turn due to differential rotation of each wheel 106*a*, 106*b*. While described and illustrated herein as using an internal combustion engine, other prime movers (such as an electrical motor) are also possible. The engine 104 may be attached to the frame 102 at a location selected to approximately equalize a weight supported by each of the wheels 106.

The snowthrower 100 may include a housing 110 attached to the frame 102 and an auger 160 positioned within the housing 110. The housing 110 may define a partially enclosed volume such that the housing may at least partially surround or enclose the auger 160. Lowermost portions of the housing 110 (e.g., the skids 118), together with the wheels 106, may form ground contact portions of the snowthrower 100.

The housing 110 may define a front-facing collection opening 111 positioned forward of the auger 160. The auger 160 is adapted for rotating (e.g., via engine 104 power) within, and relative to, the housing 110 about a transverse or auger axis 161. The housing 110 may include a pair of spaced-apart sidewalls 112 connected to one another by a rear wall 114 such that the housing forms the generally front-facing collection opening 111 defining a partially enclosed volume or chamber containing the auger 160. An upper wall 115 of the housing may also be provided. Regardless of the wall configuration, the auger may be positioned between the collection opening 111 and the rear wall 114 as shown in FIG. 1A.

As used herein, "longitudinal axis" or "longitudinal direction" refers to a long axis of the snowthrower 100, e.g., the centerline longitudinal axis 101 extending in the travel or fore-and-aft direction as shown in FIG. 1A. "Transverse" or "transverse axis" refers to a direction or axis extending side-to-side, e.g., a horizontal axis that is normal or transverse to the longitudinal axis 101 of the vehicle, like the auger axis 161.

The housing 110 may also define a discharge opening or outlet 116 and a discharge chute 120. The discharge chute 120 may be operatively coupled to the housing 110 such that the discharge chute 120 fluidly communicates with the discharge outlet 116 so that snow within the housing 110 may be ejected through the discharge chute 120 (via the discharge outlet 116). For example, the discharge chute 120 may include sidewalls 122 that define a passageway. This passageway of the chute 120 may communicate with the partially enclosed volume of the housing 110 (through the discharge outlet 116) and, thus, with the front-facing collection opening 111.

The discharge chute 120 may be adapted to rotate about a chute axis and may include an adjustable deflector to help direct snow exiting the discharge chute 120, as known in the art. Additionally, in some embodiments, the sidewalls 122 of the discharge chute 120 may taper outwardly as the sidewalls 122 extend downwardly and connect to the housing 110. The tapered sidewalls 122 may assist in guiding snow from the discharge outlet 116 and through the discharge chute 120. Additionally, the tapered sidewalls 122 may allow any snow buildup or ice to drop downward through the discharge chute 120 without obstruction.

Figure 1B:
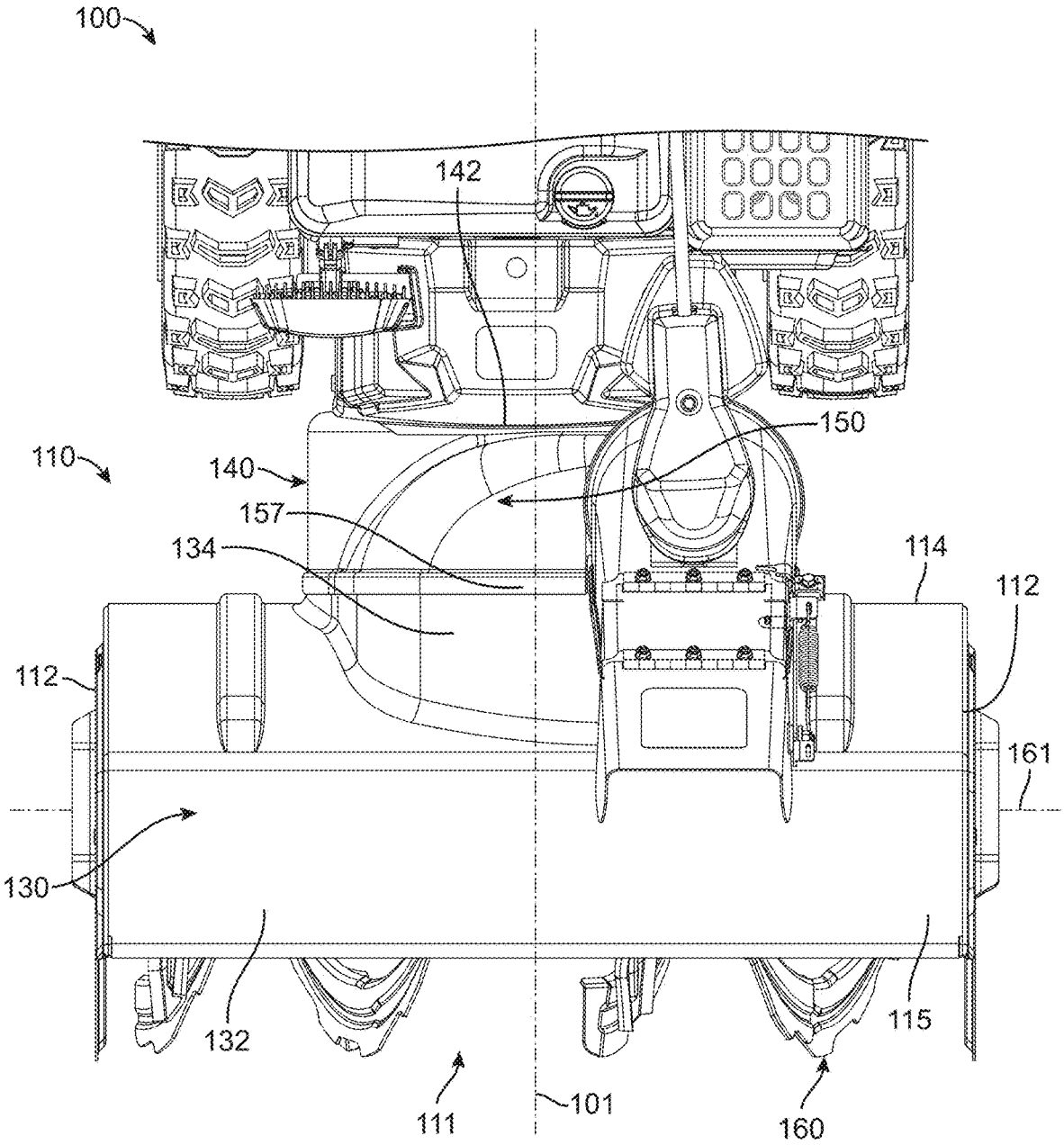
FIG. 1B is a top plan view of a portion of the snowthrower of FIG. 1A.
Figure 2:
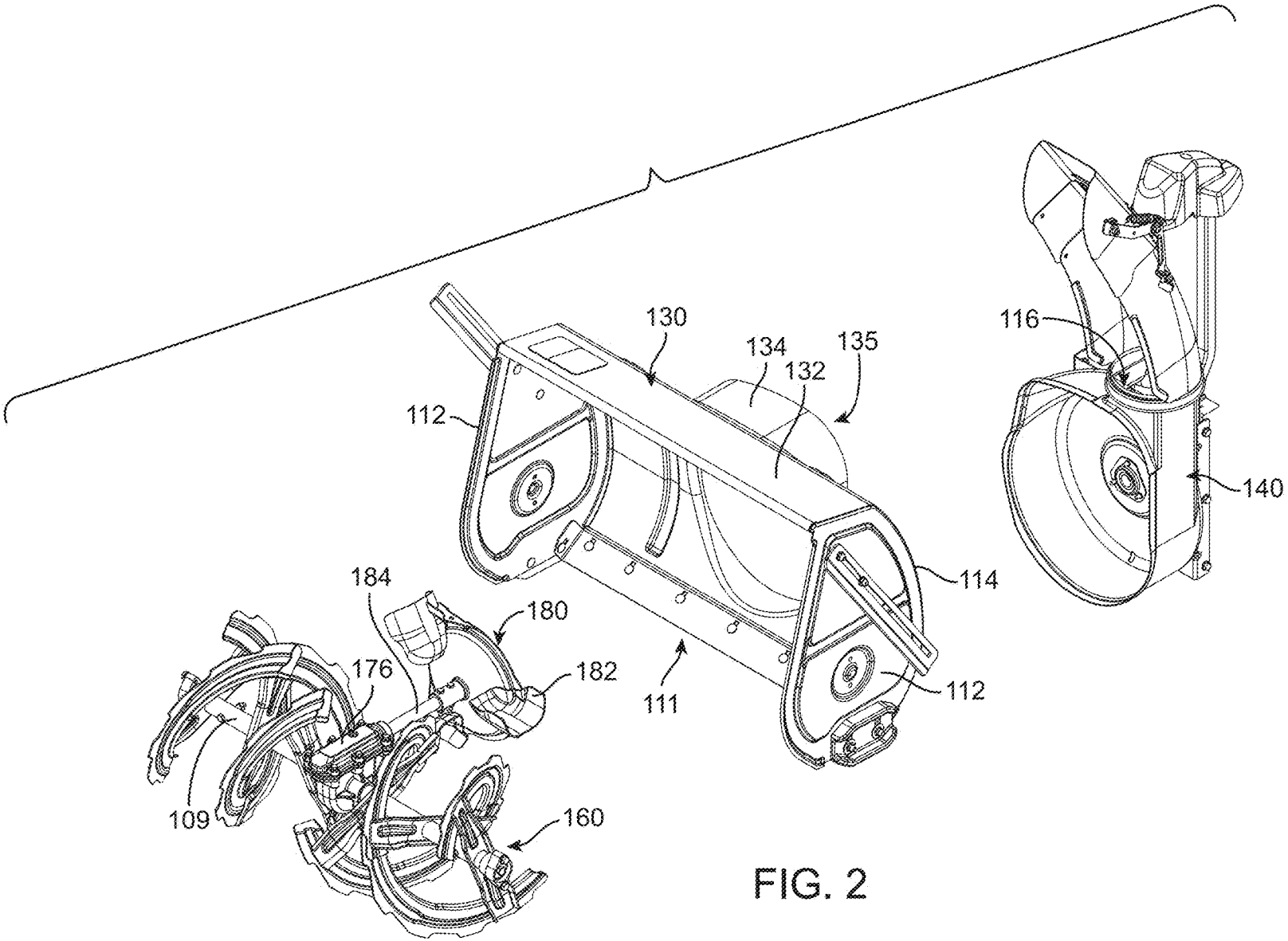
FIG. 2 is an exploded perspective view of a portion of the snowthrower of FIG. 1A.

In some embodiments, the housing 110 includes both an auger housing 130 and an impeller housing 140, as also illustrated in the exploded view of FIG. 2. The auger housing 130 and the impeller housing 140 may be coupled together to form the structure of the housing 110 (e.g., as shown in FIG. 1B). Further, the auger housing 130 may include a front portion 132 and a rear portion 134. The front portion 132 may include the two spaced-apart sidewalls 112 connected to one another by the rear wall 114 to define a front-facing collection opening 111. The rear portion 134, on the other hand, may protrude from the rear wall 114 of the front portion 132 and may define a rear-facing opening 135 (see FIG. 2).

In some embodiments, the front portion 132 of the auger housing 130 may be described as integral with the rear portion 134 of the auger housing 130. In other words, the front and rear portions 132, 134 of the auger housing 130 may be manufactured to be one singular piece. For example, the auger housing 130 may be manufactured such that the front portion 132 is formed while leaving extra material located proximate the rear-facing opening 135 and the extra material is extruded to form the rear portion 134. Therefore, the rear portion 134 is a protrusion or extension of the front portion 132. In other embodiments, the rear portion 134 may be welded to the front portion 132. In other housings known in the art, an auger housing may be formed with an opening in the rear wall and an impeller housing may be coupled or attached to a rear wall of the auger housing such that the impeller housing is in fluid communication with the auger housing. The auger housing 130, as described herein, may include (e.g., be formed from) aluminum, steel, plastic, etc. By forming the front portion 132 and the rear portion 134 using one unitary piece, the attachment of the impeller housing 140 to the auger housing 130 may be simplified and more robust. In some embodiments, the impeller housing 140 and the rear portion 134 may be formed from one unitary piece and attached to the front portion 132 of the auger housing 130.

The snowthrower 100 may also include the auger 160 positioned within the auger housing 130 between the collection opening 111 and the rear wall 114. The auger 160 may be adapted to rotate in a first direction, relative to the auger housing 130, about an auger axis 161. The auger 160 may be adapted to rotate such that snow entering the collection opening 111 is collected by the auger 160 and moved towards the center of the auger housing 130. Specifically, the auger 160 may rotate such that snow captured between the sidewalls 112 is directed towards the center of the collection opening 111, where it then enters the impeller housing 140. The auger 160 may be driven or rotated by an auger gear housing 176 (e.g., see FIGS. 2 and 4) that is operatively coupled to the engine 104. Further, the auger 160 may be coupled to an auger shaft 109 (which is, e.g., rotatably coupled between the sidewalls 112) that extends along the auger axis 161, about which the auger 160 rotates. The exemplary auger 160 will be described more specifically herein.

The impeller housing 140 may be coupled to the auger housing 130 to form the housing 110. For example, the impeller housing 140 may be coupled to the auger housing 130 at the rear-facing opening 135 of the rear portion 134 (of the auger housing 130). The impeller housing 140 may be attached or coupled to the auger housing 130 (e.g., the rear portion 134) in any suitable way. For example, the impeller housing 140 may be attached or coupled to the auger housing by welding, fastening, crimping, mechanical interlocking, etc.

Figure 9:
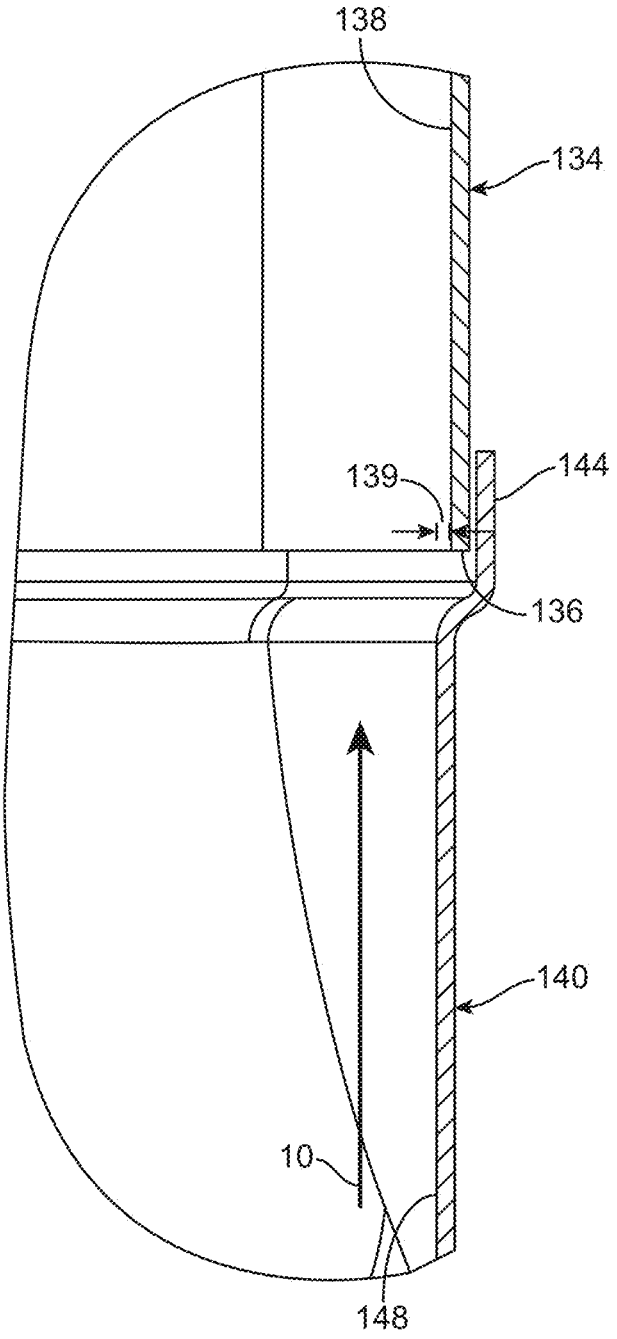
FIG. 9 is a cross-sectional view of an intersection between an auger housing and an impeller housing of the snowthrower of FIG. 1A.

In some embodiments, the impeller housing 140 may be adapted to receive an edge 136 of the rear portion 134 of the auger housing 130 (e.g., an edge 144 of the impeller housing 140 flared or offset outwardly to receive the auger housing 130), for example, as shown in the cross-sectional view of FIG. 9. In other embodiments, the rear portion 134 of the auger housing 130 may be adapted to receive the impeller housing 140. As a result, a portion of the impeller housing 140 (e.g., the offset edge 144) may overlap a portion of the auger housing 130 (e.g., the edge 136) to provide a greater surface area in which to couple the components together (e.g., by welding). Because of this overlap between the impeller housing 140 and the auger housing 130, the sidewalls that form each of the impeller housing 140 and the rear portion 134 of the auger housing 130 may provide a smoother transition at an intersection of the impeller housing 140 and the rear portion 134. For example, an inner surface 138 of the rear portion 134 and an inner surface 148 of the impeller housing 140 may align to provide a consistent (e.g., generally flat) surface for the flow of snow (e.g., the direction of snow is denoted by reference numeral 10). In some embodiments, the inner surface 138 of the rear portion 134 may be aligned with or recessed from the inner surface 148 of the impeller housing 140 (e.g., recessed by a gap distance 139). As such, the inner surface 138 of the rear portion 134 may not interfere or interrupt the path of snow passing by such that, e.g., snow does not get "caught" at this intersection. Furthermore, the impeller housing 140 and the rear portion 134 of the auger housing 130 may define a similar corresponding cross-sectional shape (e.g., a non-circular cross-sectional shape) to provide a consistent transition and flow area for snow to pass therethrough.

In one or more embodiments, the impeller housing 140 may also define the discharge outlet 116. Snow that is collected by the housing 110 passes through the auger housing 130 (via the auger 160) into the impeller housing 140 and is then ejected through the discharge outlet 116. The discharge outlet 116 may be located at any suitable position on the impeller housing 140. For example, as shown in FIGS. 1A and 1B, the impeller housing 140 defines the discharge outlet 116 at a top of the impeller housing 140. As described herein, the discharge chute 120 may be attached to the impeller housing 140 and in fluid communication with the discharge outlet 116 such that snow ejected through the discharge outlet 116 may be directed in a specific direction by the discharge chute 120.

Figure 3:
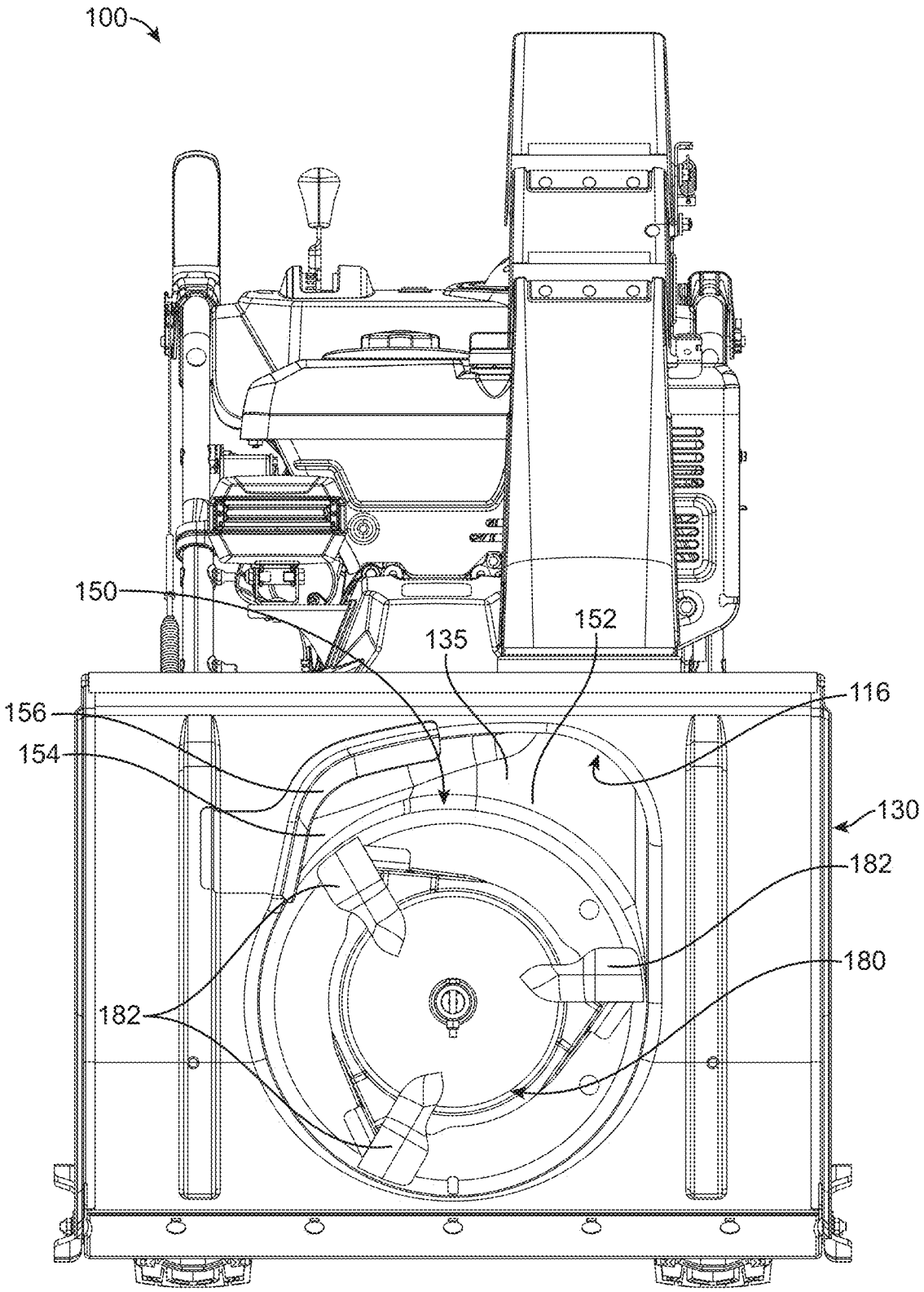
FIG. 3 is a front elevation view of the snowthrower of FIG. 1A with the auger removed.

As described briefly above, the snowthrower 100 may include the impeller 180 (e.g., as shown in FIGS. 2 and 3) that is adapted to receive snow transported by the auger 160 and to eject snow outwardly through the discharge outlet 116. In one or more embodiments, the impeller 180 may be positioned within the impeller housing 140 proximate the discharge outlet 116. The impeller 180 may be operatively coupled to the engine 104 to rotate about an axis that is parallel to the longitudinal axis 101 (see FIG. 1A). The impeller 180 may include blades 182 that are positioned radially, spaced away from the axis of the impeller 180, and oriented such that snow delivered by the auger 180 is ejected by the blades 182 through the discharge outlet 116. Furthermore, the impeller 180 may be coupled to a drive shaft 184 (e.g., as shown in FIG. 2) that is operatively coupled to the auger gear housing 176 such that rotational motion from the engine rotates both the auger 160 (via auger shaft 109) through the auger gear housing 176, and the impeller 180.

As shown in FIG. 3, the rear-facing opening 135 of the rear portion 134 (of the auger housing 130) and the impeller housing 140 may define a shape that is non-circular. Further, as shown in FIG. 3, the impeller 180 may extend along a path that is circular, however, the rear portion 134 (of the auger housing 130) and the impeller housing 140 may define a chamber that protrudes away from the impeller 180 in a non-circular shape. This non-circular shape may maintain a consistent cross-sectional profile between the impeller housing 140 and the rear portion 134 (e.g., progressing along the longitudinal axis 101). The extra space or chamber that extends beyond (e.g., above, as shown in FIG. 3) the surface of revolution of the impeller 180 and away from the discharge outlet 116, may form a bypass passage 150.

The bypass passage 150 may act as a "relief valve" for snow that would otherwise be ejected through the discharge outlet 116 as a result of the impeller 180. In other words, in some instances, snow that is transported by the blades 182 of the impeller 180 may not effectively pass through the discharge outlet 116 for a variety of reasons (e.g., trajectory from the impeller; quantity, type, and water content of the snow; etc.). In snowthrowers that do not include a bypass passage, the snow that cannot be ejected by the impeller may accumulate and eventually plug or block the discharge outlet 116. Such blockage may need to be manually cleared with a tool. The bypass passage 150 may provide a path for such snow to travel back into the auger housing 130. The snow may then be collected by the auger 160 and again transported to the impeller 180 to be ejected out of the discharge outlet 116.

Figure 8A:
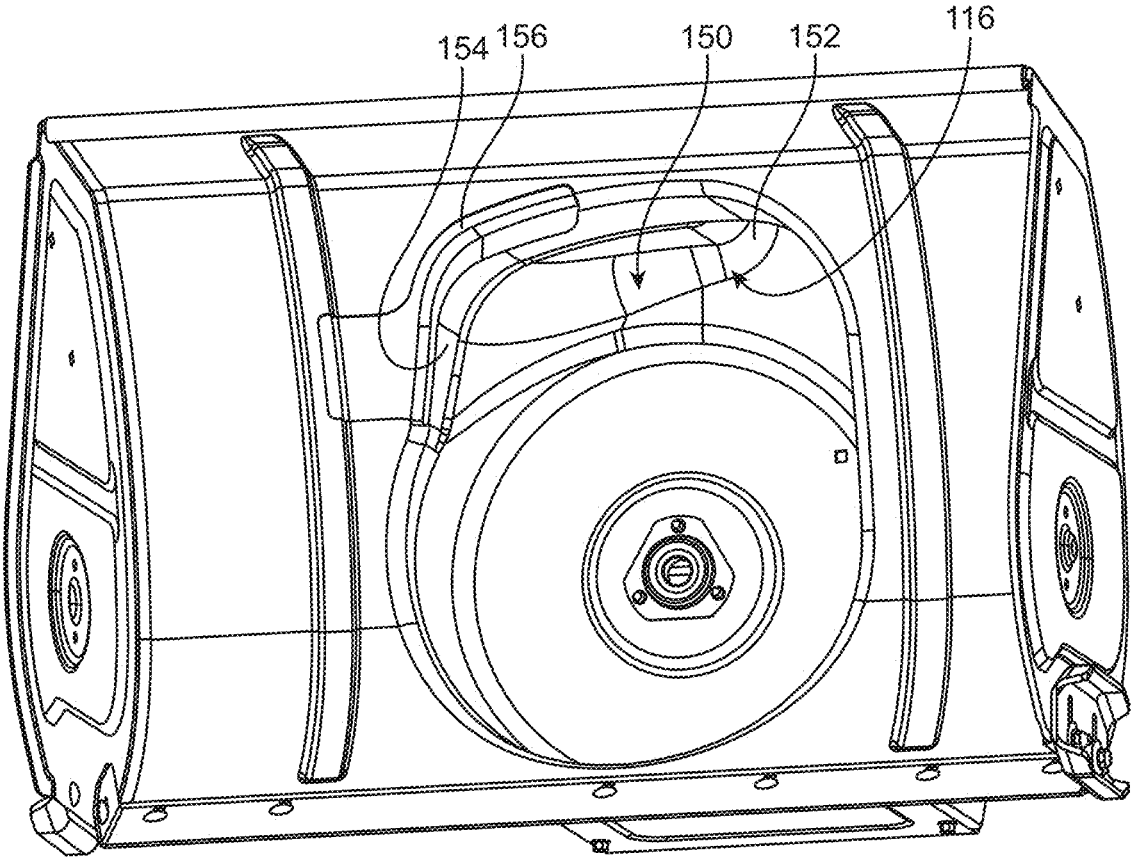
FIGS. 8A and 8B are both front lower perspective views of a portion of the snowthrower of FIG. 1A with some structure removed.
Figure 8B:
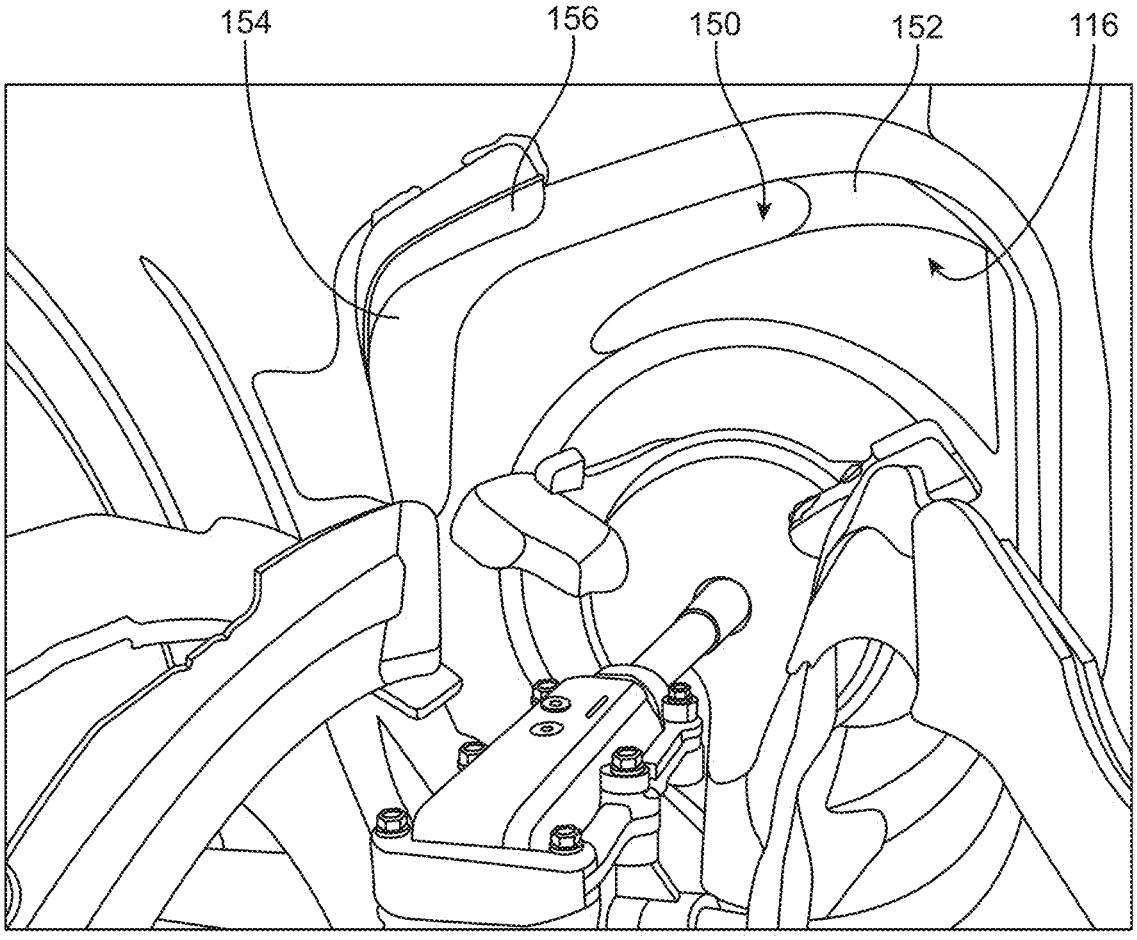

The bypass passage 150 may extend between a bypass entrance 152 and a bypass exit 154, as shown in FIGS. 3, 8A and 8B. The bypass entrance 152 may be located proximate the discharge outlet 116 and the bypass exit 154 may be spaced away from the discharge outlet 116. The bypass passage 150 may provide a chamber that is at least 0.25 inches beyond the path of the impeller 180 and may extend for a distance of 5 to 8 inches (e.g., about 7 inches). Although, it is noted that the bypass passage 150 may have varying dimensions measured at different points (e.g., the bypass passage 150 may taper towards the bypass exit 154), therefore, these dimensions may describe the volume of the bypass passage 150 generally. For example, the bypass passage 150 may define a gradual curve, rather than an abrupt change of direction, in an attempt to, e.g., maintain the velocity of snow as it is being bypassed. In one or more embodiments, the bypass passage 150 may include a deflector 156 positioned at or near the bypass exit 154. The deflector 156 may be adapted to direct snow from the bypass passage 150 (e.g., downwardly and/or towards the center of the auger housing 130) into the auger housing 130 and, e.g., into the auger 160 stream. In other words, the deflector 156 may ensure snow that travels through the bypass passage 150 remains within the auger housing 130 (e.g., to be collected by the auger 160) and is not thrown too far outside (i.e., forward of) of the auger housing 130.

At least a portion of the rear portion 134 of the auger housing 130 and at least a portion of the impeller housing 140 may together form the bypass passage 150. In other words, each of the rear portion 134 of the auger housing 130 and the impeller housing 140 are shaped to define portions of the bypass passage 150. The attachment of the rear portion 134 of the auger housing 130 with the impeller housing 140 may form the bypass passage 150. In other embodiments, the bypass passage may be entirely formed by only one of the rear portion and the impeller housing.

Additionally, the bypass passage 150 may define a top surface 157 (e.g., as shown in FIGS. 1A-1B) that is formed by a top surface of the impeller housing 140 and a top surface of the rear portion 134. The top surface 157 of the bypass passage 150 may directly intersect (and, e.g., join) the rear wall 114 of the auger housing 130 (e.g., without any intervening surface). In other words, the top surface 157 of the bypass passage 150 may extend generally horizontal (e.g., between the impeller housing 140 and the rear portion 134) before intersecting the rear wall 114 of the auger housing 130. As such, the impeller housing 140 may be attached to the rear portion 134 such that the top surface of the impeller housing 140 corresponds or coincides with the top surface of the rear portion 134 (e.g., along a generally horizontal plane).

In one or more embodiments, the bypass passage 150 may extend along an arcuate path as shown from the contour lines of the impeller housing 140 and the rear portion 134 illustrated in FIG. 1B. For example, the bypass passage 150 may extend along a rear wall 142 of the impeller housing 140 that extends in a direction parallel to the transverse axis (e.g., perpendicular to the longitudinal axis 101) proximate the discharge outlet 116 (e.g., at the bypass entrance 152). The bypass passage 150 may then terminate (e.g., the point at which snow is thrown back into the auger 160) extending along a direction that is parallel to the longitudinal axis 101 (e.g., in the impeller housing 140 and/or the rear portion 134 of the auger housing 130). In between the rear wall 142 of the impeller housing 140 and the point at which the bypass passage 150 terminates, the bypass passage 150 may define an arcuate or curved shape. Further, snow may be deflected by the deflector 156 such that the snow is thrown back into the auger 160 as described herein.

Figure 4:
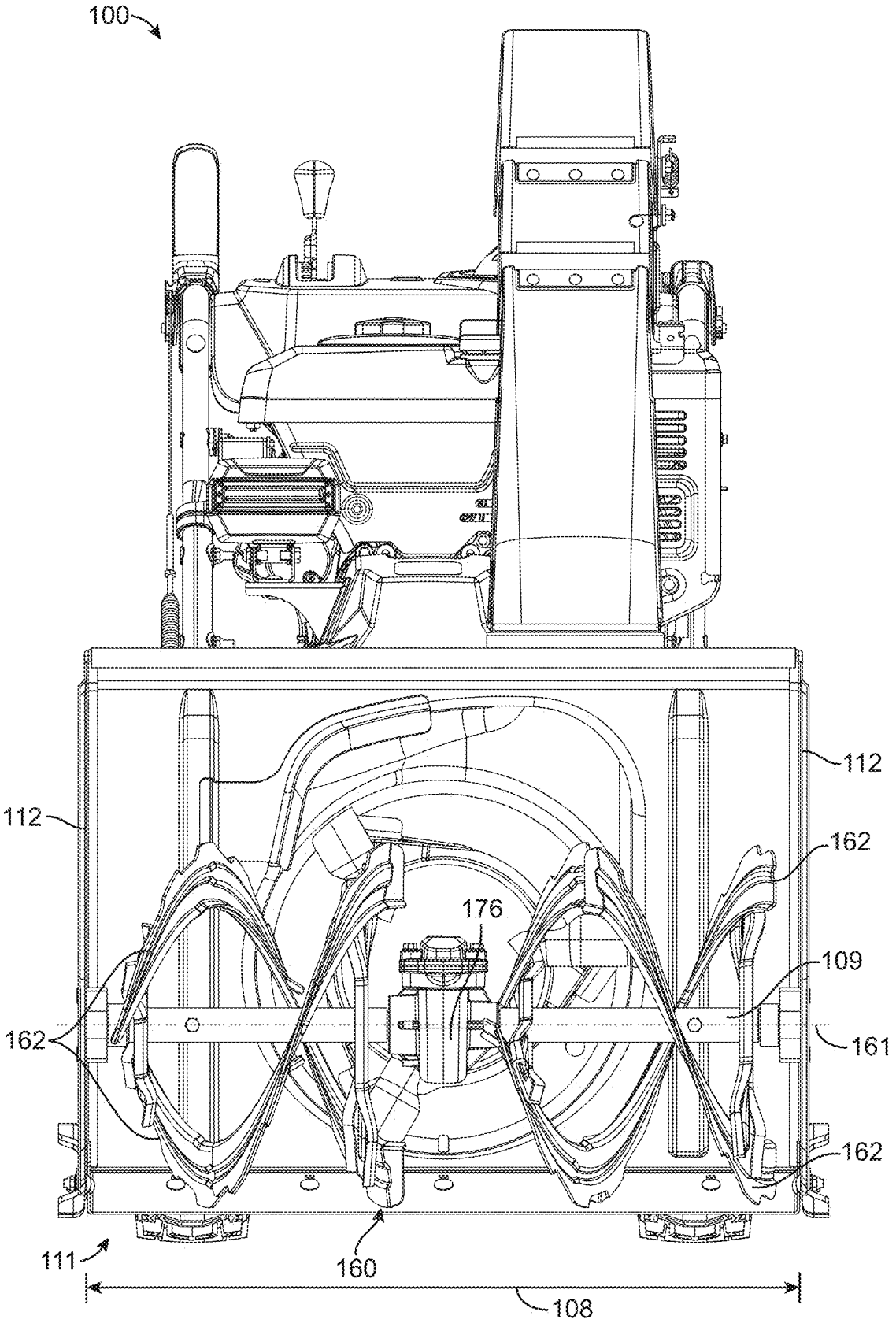
FIG. 4 is a front elevation view of the snowthrower of FIG. 1A.

Furthermore, the snowthrower 100 may be manufactured in a variety of different widths for different sized snowthrowers. For example, a wider snowthrower 100 may cover more surface area per unit time as compared to a narrower snowthrower 100. A width 108 of the snowthrower 100 and its the auger 160 may be measured along the auger axis 161 between the two spaced-apart sidewalls 112, as shown in FIG. 4. That is, the auger 160 may extend between the two spaced-apart sidewalls 112 and span the width 108. For example, in some embodiments, snowthrowers 100 having a width 108 of 20 inches to 32 inches, are common, although larger (and smaller) widths are also possible.

As a result, different sized augers are needed to provide the desired different widths 108 of a particular snowthrower 100. In some embodiments, the auger 160 may include a helical flyte 162 (or multiple helical flytes 162) adapted to collect snow. For example, the auger 160 may include a helical flyte 162 on each of the transverse left and right sides of the auger gear housing 176. Specifically, as shown in FIG. 4, the auger 160 may include two helical flytes 162 on each of the transverse left and right sides of the auger gear housing 176 (i.e., two flytes 162 on each side of the auger gear housing 176). Each of the two helical flytes 162 may diametrically oppose the other across the auger axis 161. The helical flytes 162 may be attached to an auger shaft 109 (via supports 126, which are better shown in FIGS. 5-6), which spans the width of the auger housing 130 and is rotationally coupled to each two spaced-apart sidewalls 112.

In order to create the various widths 108 of the auger 160, various sized helical flytes 162 may be needed. Therefore, different helical flytes 162 are typically manufactured to fit a particular width 108 of the auger 160. In other words, a specific helical flyte may be manufactured for an auger of a wider snowthrower (e.g., a 32-inch auger), while a different specific helical flyte may be manufactured for an auger for a narrower snowthrower (e.g., a 24-inch auger). Embodiments of the present disclosure, however, provide a design using a single sized helical flyte 162 that allows for multiple flytes (of the single size) to be coupled together in a variety of ways to achieve differing widths. Therefore, the single sized helical flyte 162, as described herein, may simplify the manufacturing process by reducing the number of different helical flytes required to create different auger widths.

An illustrative construction of helical flytes in accordance with embodiments of the present disclosure are shown in FIGS. 5A-5B and 6A-6B. As shown in these views, the helical flyte 162 may include a first helical portion 164 extending between a first end 165 and a second end 166, and a second helical portion 170 extending between a first end 171 and a second end 172. The first helical portion 164 may be coupled to the second helical portion 170 such that the second end 166 of the first helical portion 164 and the first end 171 of the second helical portion 170 overlap (e.g., the first helical portion 164 overlaps the second helical portion 170 or the second helical portion 170 overlaps the first helical portion 164) at an overlap section 190. The first helical portion 164 may be identical to or duplicative of the second helical portion 170 (e.g., share a common width, length, thickness, and helix angle). While the figures illustrate two helical portions forming the helical flyte 162, in other embodiments, more than two helical portions may form the helical flyte 162. Further, it is noted that the helical flytes 162 shown in each of FIGS. 5A-5B and 6A-6B illustrate two helical flytes 162 (including two helical portions each) coupled to the auger shaft 109 (via the supports 126) diametrically opposing one another (e.g., across the auger axis 161). This configuration illustrated by FIGS. 5A-5B and 6A-6B is representative of one side of the auger 160.

The helical flytes 162 may include (be made of) any suitable material. For example, the helical flyte 162 may include steel, aluminum, rubber, composites, etc. Further, the first helical portion 164 may be coupled to the second helical portion 170 in any suitable way. For example, the first helical portion 164 may be coupled to the second helical portion 170 by welding, fastening, bonding, adhering, etc.

In one or more embodiments, each of the first and second helical portions 164, 170 may define a constant helix angle 169 between their respective first and second ends. In other words, measured from the auger axis 161, the first and second helical portions 164, 170 may define a constant angle or pitch as each helically circumscribes the auger shaft 109. For example, the helix angle 169 may be about 55 degrees to 75 degrees. More specifically, the second end 166 of each first helical portion 164 and the first end 171 of each second helical portion 170 (which may be coupled together) may define complementary helix angles such that the first helical portion 164 and the second helical portion 170 coextend along the overlap section 190. In other words, the pitch of the first and second helical portions 164, 170 at the ends that are coupled together (e.g., at the overlap section 190) may be complementary to maximize the amount of surface area that may be coupled (e.g., welded) together.

For example, each of the first and second helical portions 164, 170 may include a first surface 167, 173 (respectively) and an opposing second surface 168, 174 (respectively). The first surface 167 of the first helical portion 164 may be congruent to and contact the second surface 174 of the second helical portion 170 at the overlap section 190. Specifically, in some embodiments, more than or equal to 50%, more than or equal to 60%, and/or more than or equal to 80% of a surface area of the first surface 167 (at the overlap section 190) of the first helical portion 164 may contact the second surface 174 of the second helical portion 170. Likewise, more than or equal to 50%, more than or equal to 60%, and/or more than or equal to 80% of a surface area of the second surface 174 (at the overlap section 190) of the second helical portion 170 may contact the first surface 167 of the first helical portion 164. The increased amount of surface area contact in the overlap section 190 may increase the rigidity and robustness of the helical flyte 162 (i.e., the helical flytes 162 may be coupled to one another at more than just a point or edge). In some embodiments, the first helical portion 164 may be welded to the second helical portion 170 (e.g., around the perimeter or edges of each) such that the surface areas within the welded portion (e.g., in the overlap section 190) contact or mate with one another.

Figure 7:
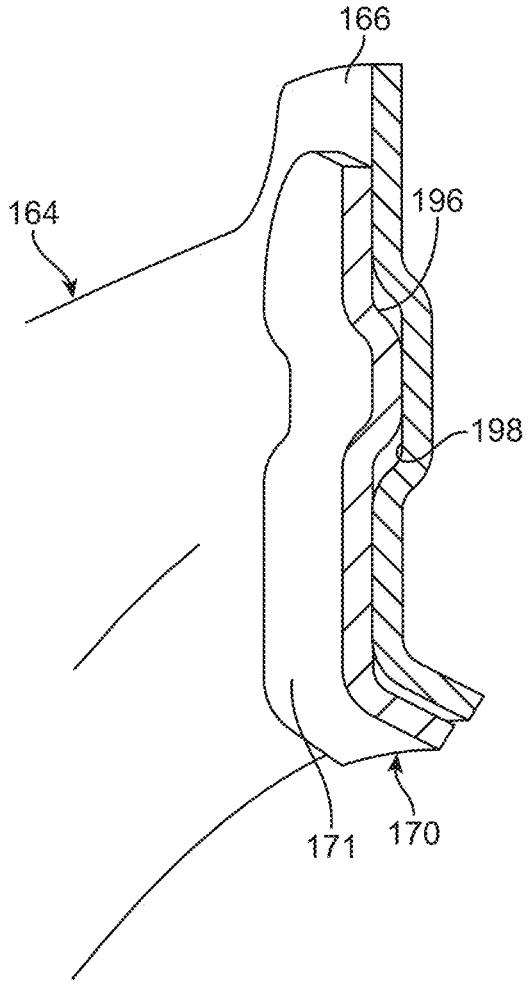
FIG. 7 is a cross-sectional view of helical flytes of an auger in accordance with one illustrative embodiment of this disclosure.

In one or more embodiments, the helical portions of the helical flyte 162 (e.g., the first helical portion 164 and the second helical portion 170) may define a spline 196 and a recess 198 extending through the helical portion, as shown in FIG. 7. For example, the surface of the first end 171 of the second helical portion 170 may define the spline 196 (e.g., a protrusion or a ridge in the surface) that extends along a center of a portion of the second helical portion 170 and the surface of the second end 166 of the first helical portion 164 may define the recess 198 that extends along a center of a portion of the first helical portion 164. The spline 196 and the recess 198 may extend for any suitable distance in the helical portions 164, 170. For example, the spline 196 and the recess 198 may extend for at least a distance for which the first and second helical portions 164, 170 may overlap as described herein. The spline 196 may be adapted to fit within the recess 198 to nest the first and second helical portions 164, 170 such that the first and second helical portions 164, 170 may be aligned. In some embodiments, the first and second helical portions 164, 170 may define any other suitable features to assist in nesting together.

Figure 5A:
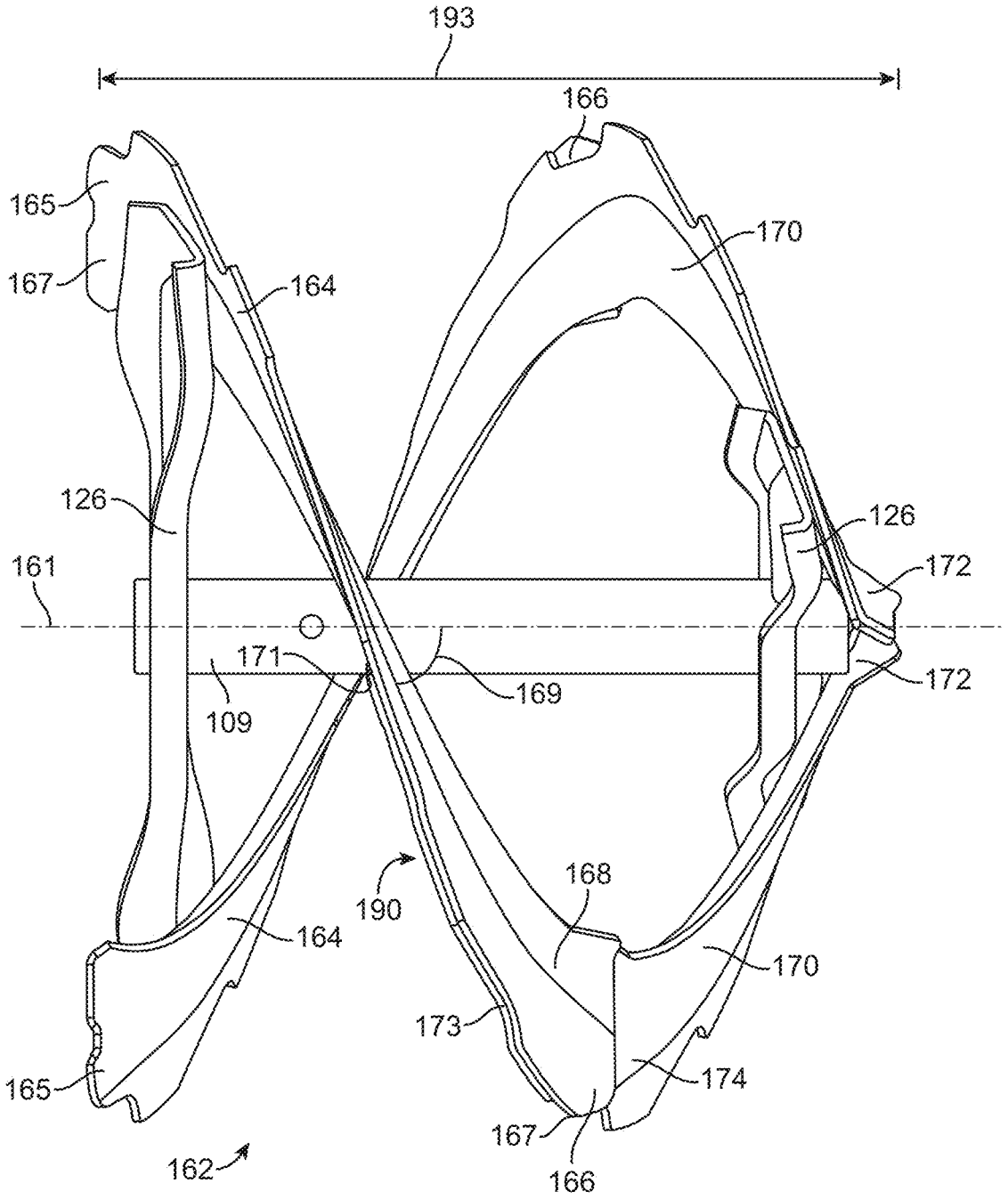
FIG. 5A is a front elevation view of an isolated auger in accordance with one illustrative embodiment of this disclosure.
Figure 5B:
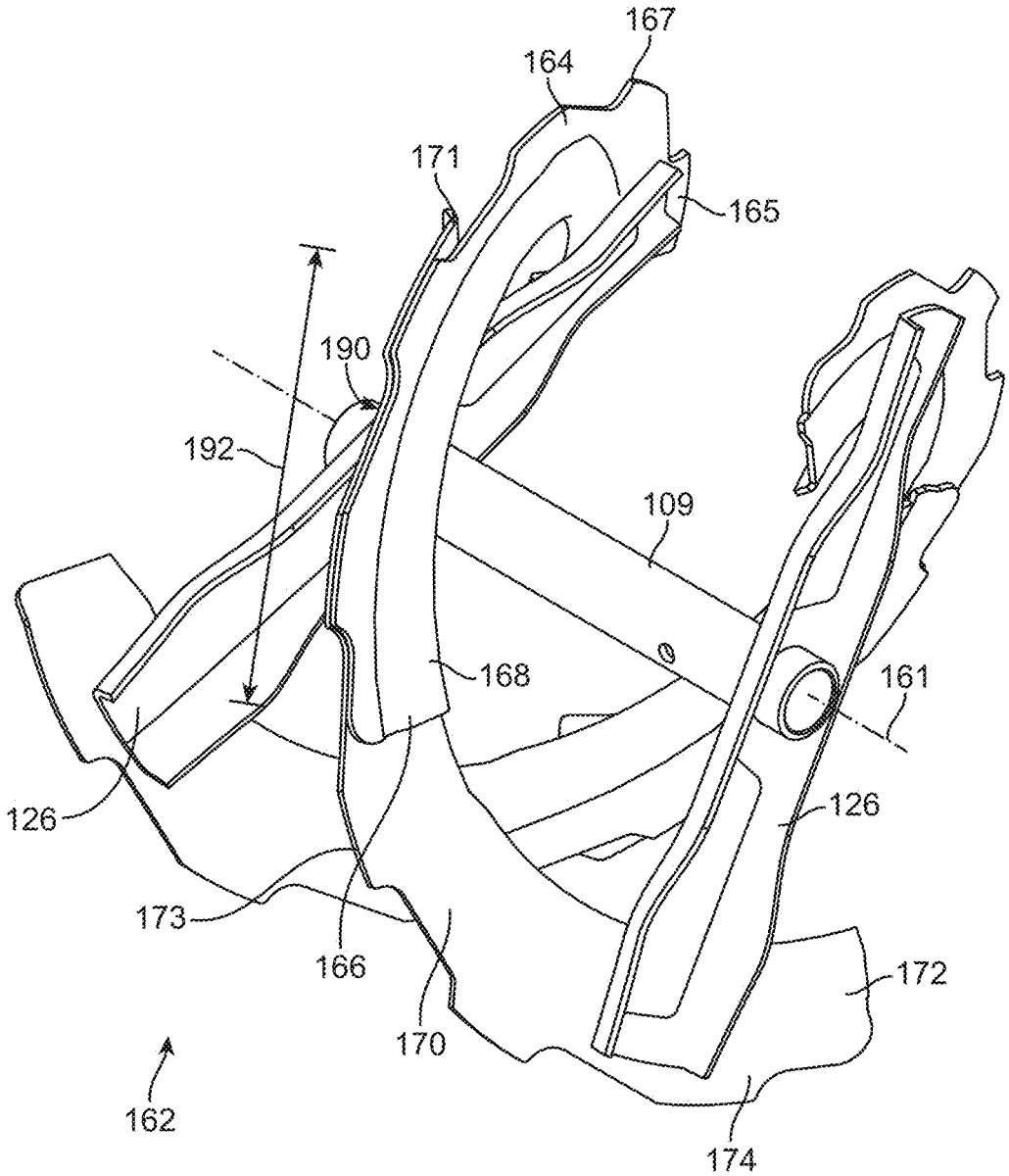
FIG. 5B is a perspective view of the auger of FIG. 5A.
Figure 6A:
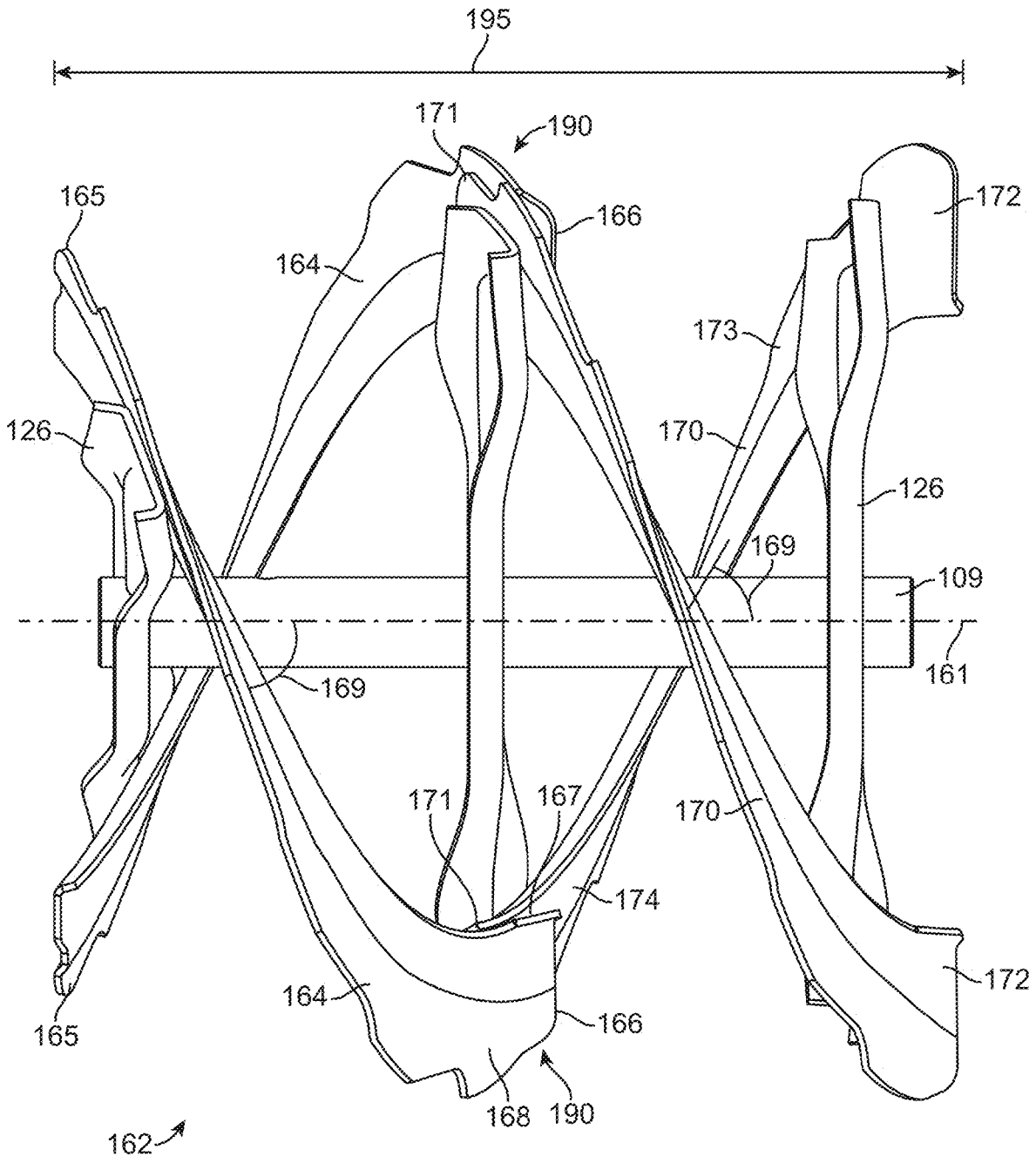
FIG. 6A is a front elevation view of an isolated auger in accordance with another illustrative embodiment of this disclosure.
Figure 6B:
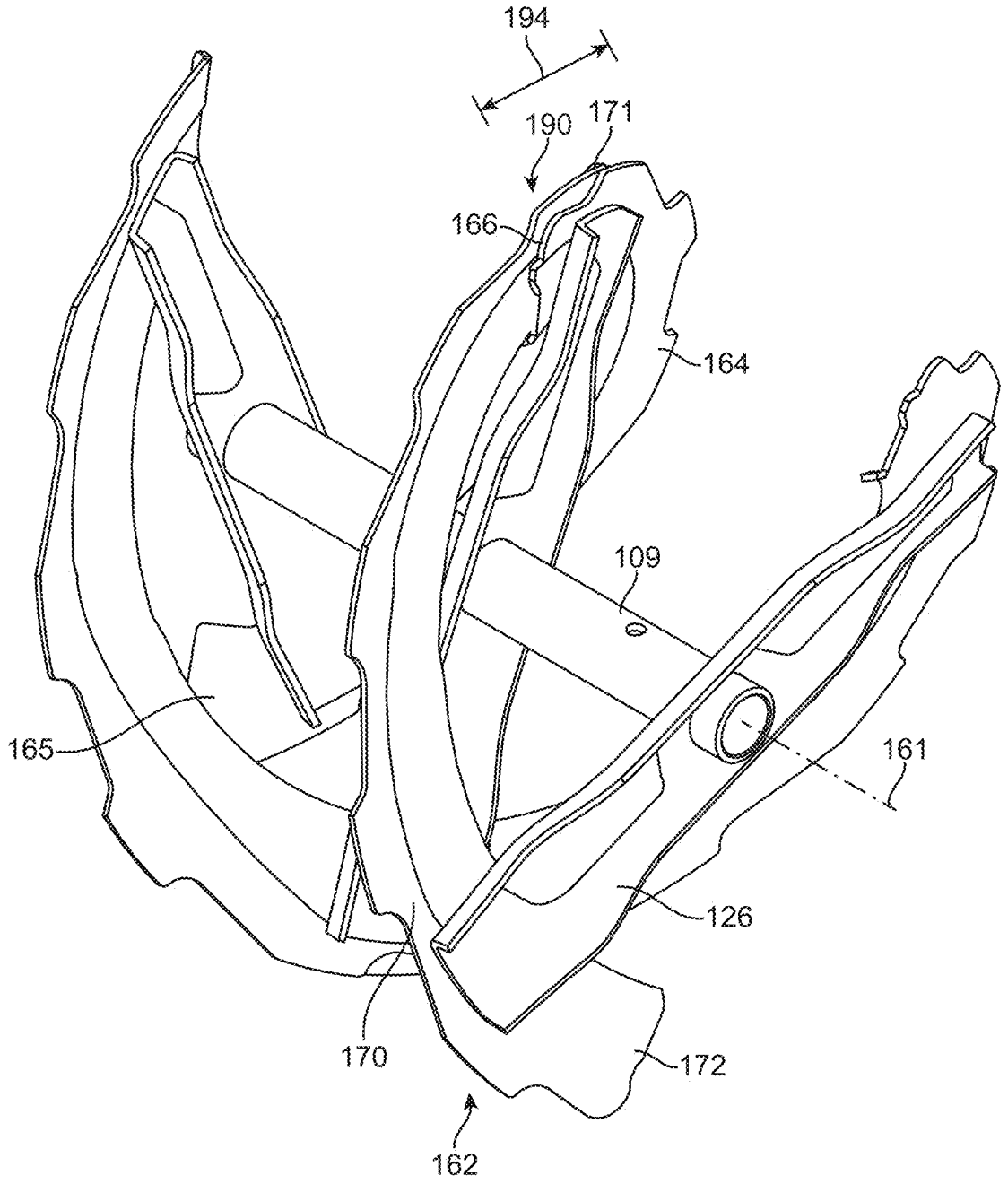
FIG. 6B is a perspective view of the auger of FIG. 6A.

The second end 166 of the first helical portion 164 may overlap the first end 171 of the second helical portion 170 (e.g., at the overlap section 190) by at least 2 inches. Depending on the overall width of the auger 160, the distance of the overlap section 190 may vary. For example, the first helical portion 164 may be adapted to overlap the second helical portion 170 by a first overlap distance 192 such that the helical flyte 162 may define a first width 193 measured along the auger axis 161, as shown in FIGS. 5A and 5B. Also, for example, the first helical portion 164 may be adapted to overlap the second helical portion 170 by a second overlap distance 194 such that the helical flyte 162 may define a second width 195 measured along the auger axis 161, as shown in FIGS. 6A and 6B. It is noted that the first width 193 and the second width 195, as shown in FIGS. 5A and 6A, respectively, are representative of a length of the helical flyte 162 located on one side of the snowthrower 100 (i.e., the snowthrower 100 includes two separate lengths of helical flyte 162 separated by, e.g., the auger gear housing 176, across the width of the snowthrower 100).

The first overlap distance 192 may be different than the second overlap distance 194 and, therefore, the first width 193 may be different than the second width 195. Specifically, the first overlap distance 192 may be more than or equal to 6 inches and/or less than or equal to 10 inches to achieve a first width 193 (e.g., for use with a 28-inch snowthrower) of more than or equal to 9 inches and/or less than or equal to 12 inches. Also, the second overlap distance 194 may be more than or equal to 1 inch and/or less than or equal to 4 inches, to achieve a second width 195 (e.g., for use with a 32-inch snowthrower) of more than or equal to 12 inches and/or less than or equal to 15 inches. Specifically, the first overlap distance 192 may be 7 inches to 8 inches and the second overlap distance 194 may be 2 to 3 inches. It is noted that the width 108 of the auger 160 (e.g., as shown in FIG. 4) may include the widths of two helical flytes 162 and the width of the auger gear box 176.

As a result of modifying the overlap distance of helical portions coupled to one another, different length helical flytes 162 may be achieved with identical helical portions. By using a single sized helical portion to create the different sized helical flytes 162, the manufacturing and handling of components (specifically, the helical portions) may be simplified. In other words, only a single size and shape helical portion may need to be accounted for in manufacturing, yet many different sized helical flytes can still be produced.

The complete disclosure of the patents, patent documents, and publications cited herein are incorporated by reference in their entirety as if each were individually incorporated.

Illustrative embodiments are described and reference has been made to possible variations of the same. These and other variations, combinations, and modifications will be apparent to those skilled in the art, and it should be understood that the claims are not limited to the illustrative embodiments set forth herein.

What is claimed is:

1. A snowthrower housing comprising:

an auger housing comprising a front portion and a rear portion, wherein the front portion comprises two spaced-apart sidewalls connected to one another by a rear wall to define a front- facing collection opening, wherein the rear portion protrudes from the rear wall of the front portion and defines a rear-facing opening;

an impeller housing coupled to the auger housing at the rear-facing opening of the rear portion, wherein the impeller housing defines a discharge outlet, and wherein at least a portion of the rear portion of the auger housing and the impeller housing form a bypass passage adapted to return snow that bypasses the discharge outlet to the auger housing, wherein a top surface of the impeller housing and a top surface of the rear portion of the auger housing form a top surface of the bypass passage, wherein the top surface of the bypass passage intersects the rear wall of the front portion of the auger housing;

an auger positioned within the auger housing between the collection opening and the rear wall, the auger adapted to rotate in a first direction, relative to the auger housing, about an auger axis, wherein the auger is adapted to collect snow; and an impeller positioned within the impeller housing and adapted to receive snow transported by the auger and to eject the snow outwardly through the discharge outlet.

2. The snowthrower housing of claim 1, wherein the front portion of the auger housing is integral with the rear portion of the auger housing.

3. The snowthrower housing of claim 1, wherein the rear-facing opening is non- circular.

4. The snowthrower housing of claim 1, wherein the bypass passage extends above a path of the impeller and away from the discharge outlet.

5. The snowthrower housing of claim 1, wherein the bypass passage extends between a bypass entrance proximate the discharge outlet and a bypass exit spaced away from the discharge outlet, wherein the bypass passage extends beyond a path of the impeller.

6. The snowthrower housing of claim 1, further comprising a discharge chute operably coupled to the discharge outlet, wherein the discharge chute defines a sidewall that tapers outwardly as the sidewall extends downwardly and connects to the impeller housing.

7. The snowthrower housing of claim 1, further comprising a deflector positioned at an end of the bypass passage and adapted to direct snow from the bypass passage to the auger housing.

8. A snowthrower comprising:

a frame;

two ground support members operatively coupled to the frame and adapted to support at least a portion of the snowthrower; and the snowthrower housing of claim 1.

* * * * *